United States Patent [19]

Kuykendall

[11] Patent Number: 4,986,572

[45] Date of Patent: Jan. 22, 1991

[54] POCKET RECEPTACLES FOR WRITING IMPLEMENTS AND MISCELLANEOUS SMALL ARTICLES

[76] Inventor: Jon Kuykendall, P.O. Box 20061, Seattle, Wash. 98142

[21] Appl. No.: 418,866

[22] Filed: Oct. 10, 1989

[51] Int. Cl.[5] ..... B42D 9/00

[52] U.S. Cl. ..... 281/15.1; 281/30; 281/42; 281/51

[58] Field of Search ..... 281/51, 15.1, 29, 30, 281/31, 34, 35, 36, 42; 402/3, 4, 70, 73, 502; 206/424; 224/209, 236, 237, 240, 253; 229/1.5 R

[56] References Cited

U.S. PATENT DOCUMENTS

| | | | |
|---|---|---|---|
| 2,846,795 | 8/1958 | Balaban | 281/51 |
| 3,068,840 | 12/1962 | Pullins | 281/30 |
| 4,395,057 | 7/1983 | Young | 281/42 |
| 4,630,843 | 12/1986 | Willat | 281/30 |

*Primary Examiner*—Douglas D. Watts
*Assistant Examiner*—Hwei-Siu Payer
*Attorney, Agent, or Firm*—Lane, Aitken & McCann

[57] ABSTRACT

A pocket carrier is formed from a soft flexible material and features pockets for carrying and storing pencils or miscellaneous items. The carrier releasably attaches to a book via two elastic cords which separately engage each book cover by passing along the inside face of each cover and next to the pages such that the carrier rests on the book's spine and the pockets face outward, away from the book.

7 Claims, 1 Drawing Sheet

POCKET RECEPTACLES FOR WRITING IMPLEMENTS AND MISCELLANEOUS SMALL ARTICLES

FIELD OF THE INVENTION

This invention relates to pocket receptacles, and more particularly to a pocketed carrier attachable to book covers for pencils, other writing implements and miscellaneous items like keys and coins.

DESCRIPTION OF RELATED ART

In the past, to meet the needs of students and others who find it convenient to carry pencils or other writing implements along with their books, a variety of articles have been designed. Generally, the carriers featured a single compartment in which to store the desired items and best accommodated books with stiff covers. In addition, the carriers employed a variety of means to releasably attach to the books.

For example, some carriers attached to books by hooks, springs or snaps. Unfortunately, a number of problems can arise using these methods. Hooks which fasten the corners of a carrier to a face of a book cover could mar or otherwise mutilate the cover, or even tear the edges of pages within the book. In addition, because hooks engage only a portion of the cover, the carrier may be precariously attached and easily dislodged or lost. Moreover, attaching the carrier by springs extending along the outside length of the book presents similar problems, while springs passing along the inside cover of a book may prevent complete closing of the book cover. Even with snap closures, the carrier may be lost since the snaps may open inadvertently during normal use of the carrier or book.

SUMMARY OF THE INVENTION

The present invention provides a convenient, secure and inexpensive carrier with one or more pockets for pencils, other writing implements and miscellaneous items like keys and coins, and overcomes the disadvantages of the prior art.

The carrier releasably attaches to book covers via two elastic cords which accommodate a wide variety of book sizes as well as both paperback and hard-bound texts. Each elastic cord engages one cover of a book from top to bottom such that the carrier rests on the book's spine and the pockets face outward. The carrier features one or more pockets which may be fastened by velcro or snaps on the pocket flaps for secure closure.

DETAILED DESCRIPTION OF THE INVENTION

Figure 1:
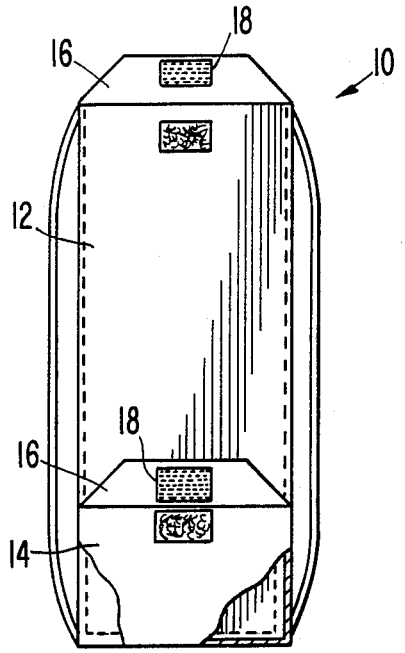
FIG. 1 is a front elevation view of the carrier, illustrating two pockets.
Figure 2:
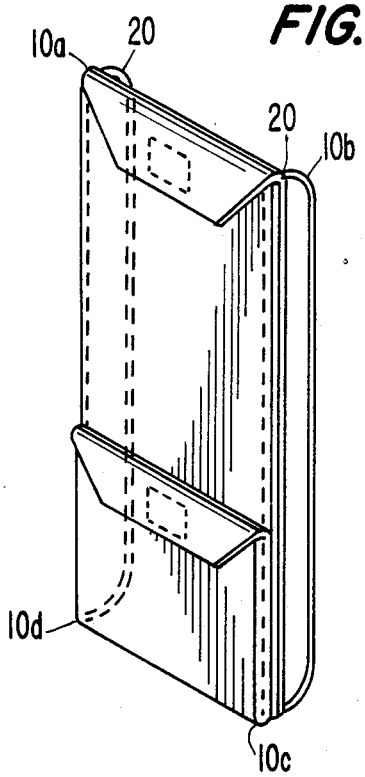
FIG. 2 is a perspective view of the same carrier, illustrating the attachment of elastic cords.

Referring to FIGS. 1 and 2, a substantially rectangular and substantially flat carrier 10 features two pockets 12 and 14 which open across the width of the carrier 10. Each pocket forms a separate storage compartment bounded by the edges of the carrier and to close, each has its own pocket flap 16 which fastens by Velcro or a snap 18 or other means known in the art. Pocket 12 extends the entire length of the carrier to accommodate long items like pencils. The storage compartment formed by pocket 14 lies on top of the lowest section of the compartment formed by pocket 12. Pocket 14 covers the entire width of the carrier 10, but does not extend the full length and therefore occupies a smaller volume. Pocket 14 is thus ideal for storing smaller items like keys or coins. The ends of two elastic cords 20 are securely attached, e.g., by sewing, to each corner 10*a*, 10*b*, 10*c* and 10*d* of the carrier 10 so that one cord extends from top to bottom along each side of the carrier. In other words, one cord is attached between corners 10*a* and 10*d*, while another cord is attached between corners 10*b* and 10*c*.

A variety of materials may be used to make the carrier 10. For example, soft plastic fabrics, like nylon, which are light-weight, inexpensive, easily handled in manufacturing processes (e.g., sewing, as suggested by stitches in FIG. 1) are suitable and come in numerous colors. As such, nylon would be ideal for students' carriers according to this invention. However, luxurious materials like leathers or exotic skins are also suitable for more elegant carriers. Such soft materials are preferred to avoid marring the book cover or adding excessive bulk which can interfere with carrying or using the book.

Figure 3:
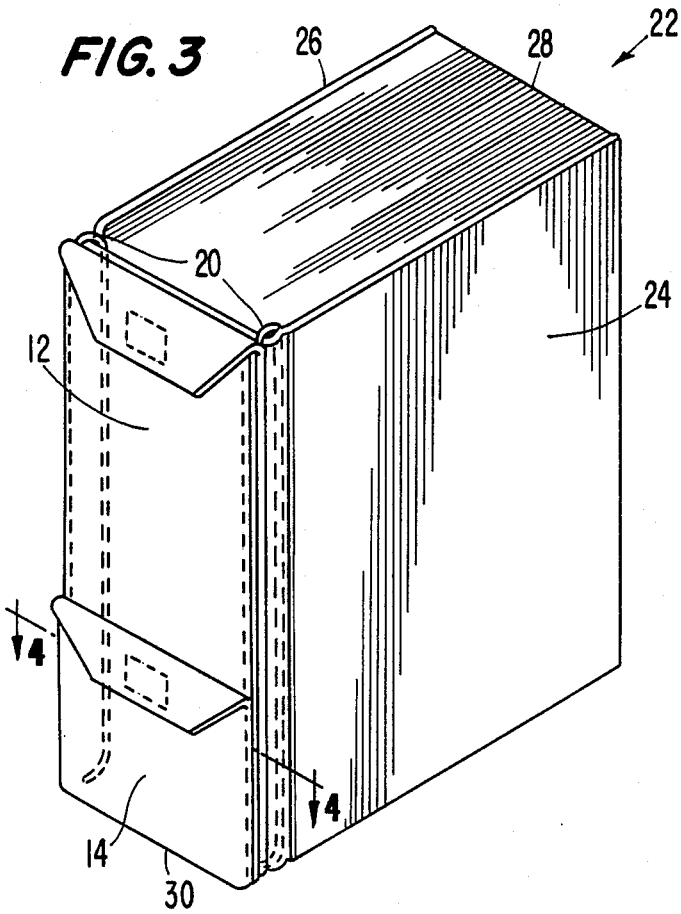
FIG. 3 is a perspective view of the carrier attached to a book.
Figure 4:
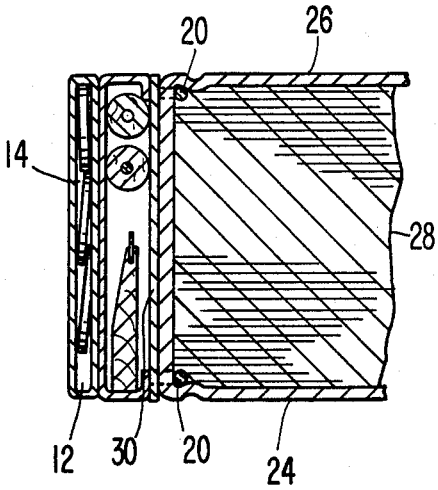
FIG. 4 is a cross-sectional view along line 4—4 of FIG. 3 illustrating the position of the elastic cords when the carrier is attached to a book.

FIGS. 3 and 4 illustrate the elastic cords 20 in use to append the carrier 10 to a book 22. When attached to the carrier 10, each cord 20 runs from top to bottom of the inside of each book cover 24 and 26 and next to the book's pages 28. Once appended, the carrier 10 extends along the spine 30 of the book 22 with pockets 12 and 14 facing outward (i.e., away from the book) and both cords engaging the covers 24 and 26. This configuration neither disturbs the pages 28 of the book since the cords do not pass between the pages nor interfere with opening, closing or carrying the book while the carrier is attached. Further, because the cords are elastic, the carrier is adaptable to books of different sizes as well as those with either paperback or hard covers. FIG. 4 also depicts how various items like pencils, rulers and coins may be carried according to this invention. As can be seen, the items are easily accessible within the pockets, but are protected from dislodgment and loss.

Having thus described the preferred embodiments of the invention in detail, those of ordinary skill in the art will be able to modify readily the invention for particular applications. Such modifications are within the spirit and scope of the invention, as it is characterized in the appended claims.

I claim:

1. An apparatus comprising:

(a) a substantially rectangular and substantially flat carrier having a first pair of corners separated by a first edge of said carrier and a second pair of corners separated by a second edge of said carrier, said first and second edges being parallel to one another;

(b) a first elastic cord connected at each of its ends to respective corners of said first pair;

(c) a second elastic cord connected at each of its ends to respective corners of said second pair; and (d) a first pocket attached to said carrier, whereby said elastic cords extend respectively along the inside of the front and back covers of a book and next to the book's pages to releasably attach the carrier to the book, and to position the carrier along the spine of the book with said first pocket facing outward.

2. The apparatus of claim 1, wherein said first pocket has substantially the same length and width as said carrier.

3. The apparatus of claim 2, wherein said first pocket comprises an opening at one end, a flap for closing said opening, and a securing means for releasably securing said flap in a closed position.

4. The apparatus of claim 3, wherein said securing means comprises a hook-and-loop type fastener.

5. The apparatus of claim 1 further comprising a second pocket, said first pocket having substantially the same length and width as said carrier, and said second pocket being of a smaller size than and partially overlaying said first pocket.

6. The apparatus of claim 1, wherein said carrier and said first pocket are composed of a soft and flexible material.

7. A method for attaching a pocket to a book comprising the steps of:

selecting an apparatus comprising a substantially rectangular and a substantially flat carrier having a first pair of corners separated by a first edge of said carrier and a second pair of corners separated by a second edge of said carrier, said first and second edges being parallel to one another, a first elastic cord connected at each of its ends to respective corners of said first pair, a second elastic cord connected at each of its ends to respective corners of said second pair, and a first pocket attached to said carrier; and releasably attaching said apparatus to a book, such that said elastic cords extend respectively along the inside of the front and back covers of the book and next to the book's pages, and such that said carrier is positioned along the spine of the book with said first pocket facing outward and with said elastic cords disposed immediately adjacent to the spine.

* * * * *